US009791234B2

(12) United States Patent
Palu

(10) Patent No.: US 9,791,234 B2
(45) Date of Patent: Oct. 17, 2017

(54) LOCKING MECHANISM FOR SUPPRESSOR MOUNT

(71) Applicant: Thunder Beast Arms Corporation, Cheyenne, WY (US)

(72) Inventor: Kurtis Allen Palu, Cheyenne, WY (US)

(73) Assignee: Thunder Beast Arms Corporation, Cheyenne, WY (US)

( * ) Notice: Subject to any disclaimer, the term of this patent is extended or adjusted under 35 U.S.C. 154(b) by 0 days.

(21) Appl. No.: 15/281,323

(22) Filed: Sep. 30, 2016

(65) Prior Publication Data

US 2017/0097205 A1 Apr. 6, 2017

Related U.S. Application Data

(60) Provisional application No. 62/236,487, filed on Oct. 2, 2015.

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/30; F41A 21/325; F41A 21/34; F41A 21/36; F41A 21/32; F41C 27/00
See application file for complete search history.

(56) References Cited

U.S. PATENT DOCUMENTS 4,576,083 A 3/1986 Seberger, Jr.
4,907,488 A 3/1990 Seberger
5,433,133 A 7/1995 La France
5,596,161 A 1/1997 Sommers
6,308,609 B1 10/2001 Davies
6,948,415 B2 9/2005 Matthews et al.
7,062,874 B1 6/2006 Smith
7,237,467 B1 7/2007 Melton
7,308,967 B1 12/2007 Hoel
7,588,122 B2 9/2009 Brittingham
7,600,606 B2 10/2009 Brittingham
7,610,710 B2 11/2009 Brittingham
7,661,349 B1 2/2010 Brittingham
7,676,976 B2 * 3/2010 Dueck ..... F41A 21/30 42/90
7,743,693 B1 6/2010 Brittingham
7,789,009 B1 * 9/2010 Brittingham ..... F41A 21/30 181/223
7,856,914 B2 12/2010 Shults et al.
7,874,238 B2 1/2011 Silvers
7,946,069 B2 5/2011 Dueck et al.
8,091,462 B2 * 1/2012 Dueck ..... F41A 21/325 42/76.01
8,196,701 B1 6/2012 Oliver
(Continued)

FOREIGN PATENT DOCUMENTS

WO WO 97/07375 A2 2/1997

*Primary Examiner* — Benjamin P Lee

(74) *Attorney, Agent, or Firm* — Swanson & Bratschun, L.L.C.

(57) ABSTRACT

A novel locking mechanism for a noise suppressor mount for a firearm comprising a muzzle attachment comprising a plurality of locking positions, a collar, and a locking arm comprising a locking notch wherein the collar rotates to move the locking notch in a circular direction into a locking position.

15 Claims, 12 Drawing Sheets

(56) References Cited

U.S. PATENT DOCUMENTS 8,201,487 B2 6/2012 Dueck et al.
8,209,895 B2 7/2012 Dueck et al.
8,286,750 B1 10/2012 Oliver
8,397,862 B2 3/2013 Shand
8,459,406 B1 6/2013 Dueck
8,490,535 B1 7/2013 Moore et al.
8,499,676 B1 * 8/2013 Moore ..... F41A 21/325 42/90
8,505,680 B2 8/2013 Dueck
8,516,941 B1 8/2013 Oliver
8,539,708 B2 9/2013 Kenney et al.
8,555,765 B2 10/2013 Graham et al.
8,584,794 B2 11/2013 Dueck
8,714,301 B2 5/2014 Shults
8,763,510 B2 * 7/2014 Dueck ..... F41A 21/26 89/14.4
8,826,793 B2 9/2014 Oliver
9,464,857 B2 * 10/2016 Lessard ..... F41A 21/34
9,513,078 B1 * 12/2016 Fulton ..... F41A 21/325
2005/0115394 A1 * 6/2005 Matthews ..... F41A 21/325 89/14.4
2006/0060076 A1 * 3/2006 Dueck ..... F41A 21/30 89/14.4
2010/0313743 A1 * 12/2010 Dueck ..... F41A 21/325 89/14.05
2011/0197487 A1 * 8/2011 Humston ..... F41A 21/34 42/1.06
2012/0103176 A1 5/2012 Latka
2012/0180623 A1 * 7/2012 Graham, II ..... F41A 21/325 89/14.4
2013/0000170 A1 * 1/2013 Dueck ..... F41A 21/26 42/1.01
2013/0180150 A1 * 7/2013 Dueck ..... F41A 21/325 42/90
2013/0180796 A1 7/2013 Dueck et al.
2014/0237881 A1 * 8/2014 Mack ..... F41A 21/325 42/90
2015/0260472 A1 9/2015 Smith
2016/0209151 A1 * 7/2016 Smith ..... F41A 21/30
2016/0209152 A1 * 7/2016 Dueck ..... B23K 26/282
2016/0209153 A1 * 7/2016 Dueck ..... F41A 21/32

* cited by examiner

LOCKING MECHANISM FOR SUPPRESSOR MOUNT

CROSS REFERENCE TO RELATED APPLICATIONS

This application claims priority to U.S. patent application Ser. No. 62/236,487 (the "'487 Application"), filed Oct. 2, 2015, by Kurtis Allen Palu, entitled "Suppressor Mount," the entire disclosure of which is incorporated herein by reference in its entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a locking mechanism for a noise suppressor mount for a firearm that prevents the suppressor from becoming loose and misaligned during use of the firearm.

BACKGROUND

A noise suppressor is a device used with a firearm to reduce muzzle blast, which is a term commonly used to describe the loud noise created during the discharge of the firearm. A noise suppressor is often attached to a firearm by threading the suppressor either directly to the barrel of the firearm or to a muzzle attachment, such as a muzzle brake or flash suppressor. Noise suppressors that are threaded to a firearm and subjected to rapid fire use have a tendency to vibrate loose during use, which can cause the suppressor to become misaligned with the firearm. When a suppressor becomes misaligned during use of the firearm, the suppressor can sustain substantial damage and significantly decrease the accuracy of the firearm. Existing suppressor systems attempt to address this problem by adding a locking mechanism to the suppressor in order to aid in the retention of the suppressor during use of the firearm. However, existing locking mechanisms only work effectively when the locking mechanism engages discrete locking positions on the firearm. When existing locking mechanisms fail to engage such locking positions, the locking mechanism will loosen, which can greatly affect the accuracy of the firearm and suppressor.

Accordingly, there is a need for a suppressor locking mechanism that does not loosen during use of the firearm.

DETAILED DESCRIPTION

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the described inventions may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features. For ease of reference and understanding, similar features of different embodiments are labeled with the same numbers.

Unless otherwise indicated, all numbers used herein to express quantities, dimensions, and so forth should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
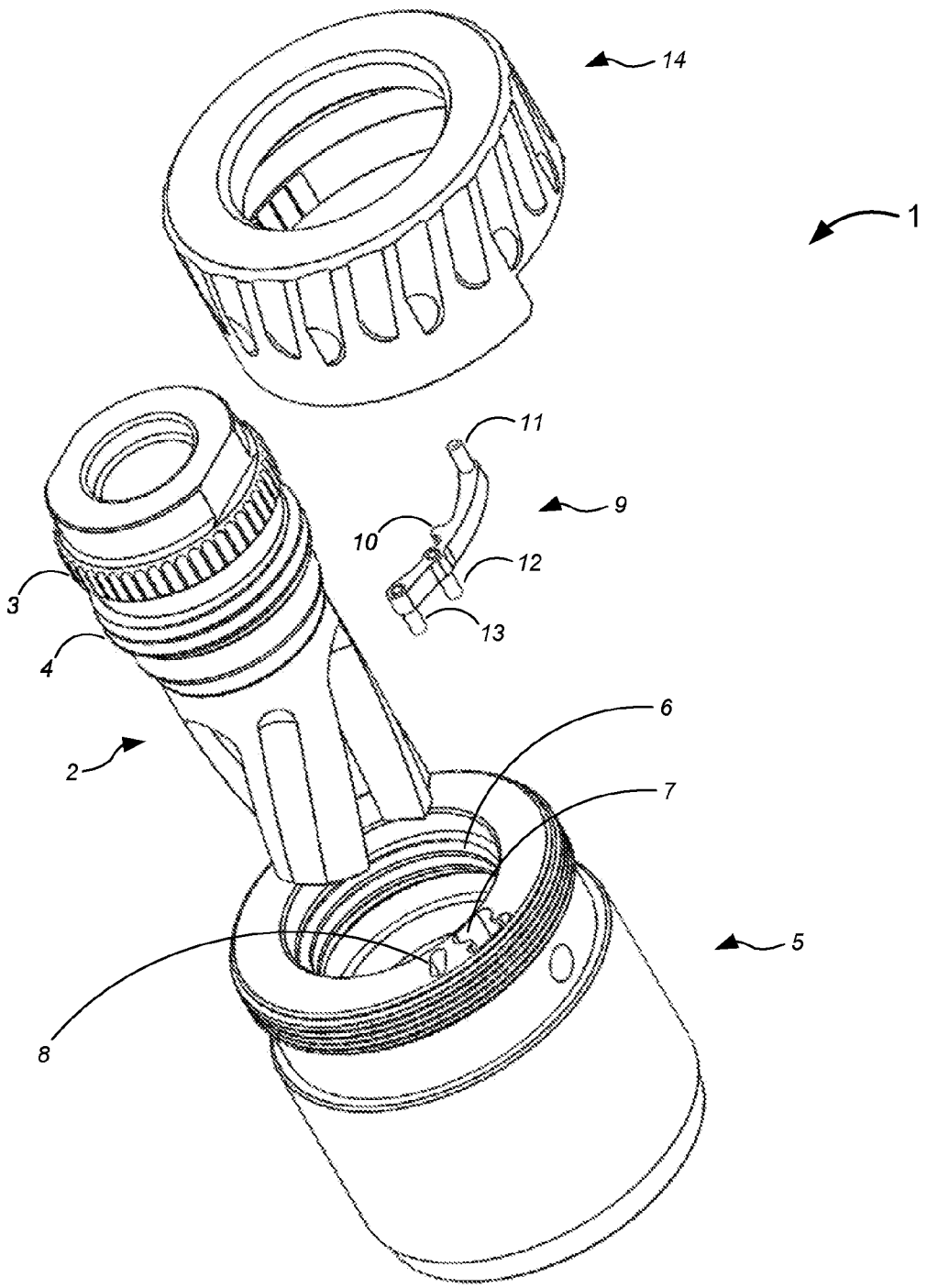
FIG. 1 shows an exploded perspective view of an embodiment of the present invention.

FIG. 1 shows an exploded perspective view of an exemplary suppressor mount locking mechanism 1 in accordance with an embodiment of the present invention. As shown, this embodiment includes a muzzle attachment 2, which is connected to the barrel of a firearm (not shown). In this exemplary embodiment, muzzle attachment 2 is an exemplary flash hider. Muzzle attachment 2 includes a plurality of locking positions 3 and a first threaded interface 4. The locking mechanism of this exemplary embodiment also includes a proximal end cap 5 with a second threated interface 6. As used in this detailed description, the term "proximal" is used to refer to the end of the component or element closest to the barrel of the firearm and the term "distal" is used to refer to the end of the component or element farthest from the barrel of the firearm. Proximal end cap 5 also includes a first and second proximal end cap slot labeled 7 and 8, respectively. Locking mechanism 1 also includes locking arm 9, which includes locking notch 10, collar pin 11, first proximal end cap pin 12, and second proximal end cap pin 13. Finally, locking mechanism 1 includes collar 14.

Figure 2:
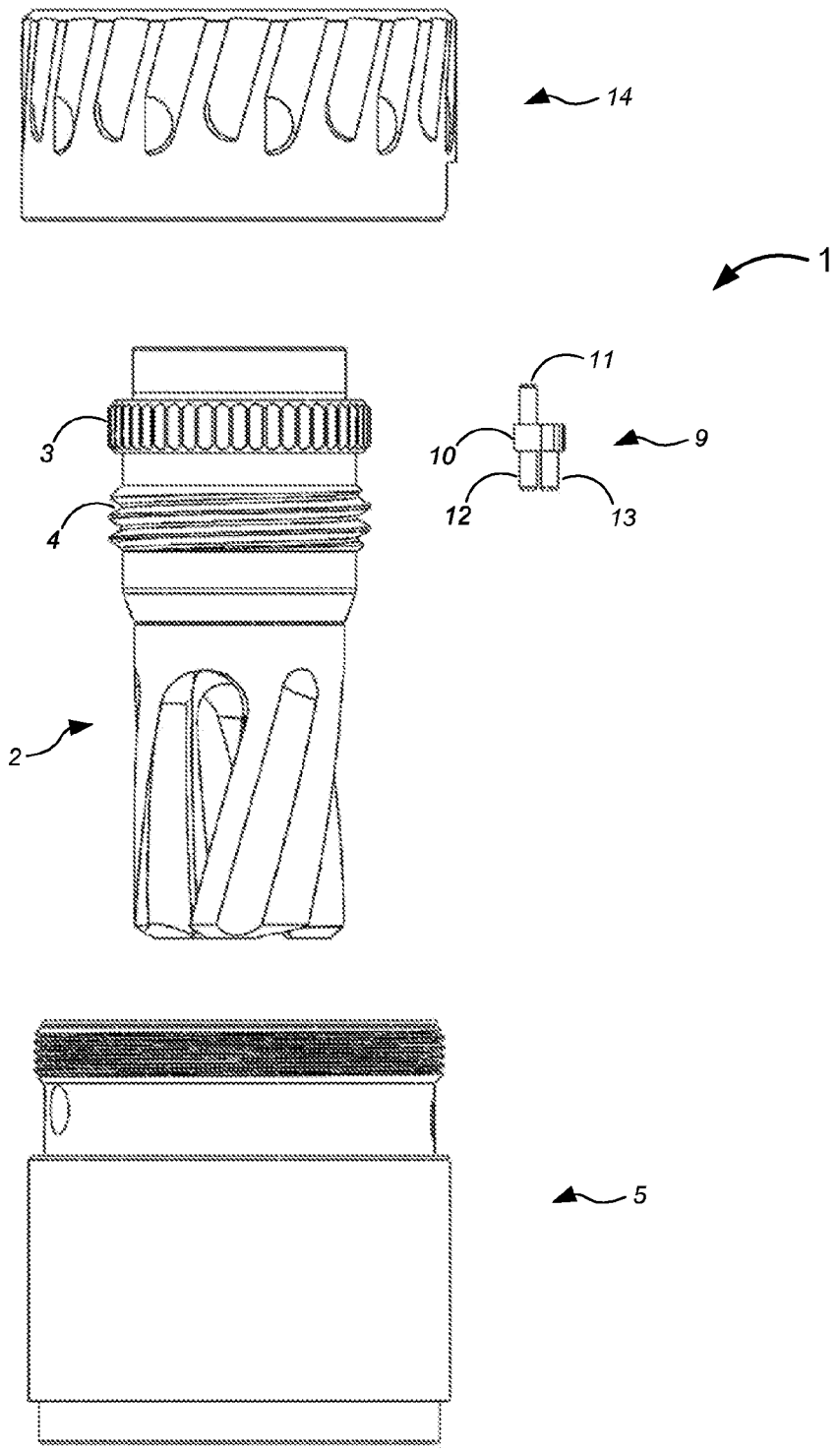
FIG. 2 shows an exploded side view of an embodiment of the present invention.

FIG. 2 shows an exploded side view of locking mechanism 1. First and second proximal end cap slots 7 and 8, respectively, are located on the top side of proximal end cap 5 and, therefore, not shown in FIG. 2.

Figure 3:
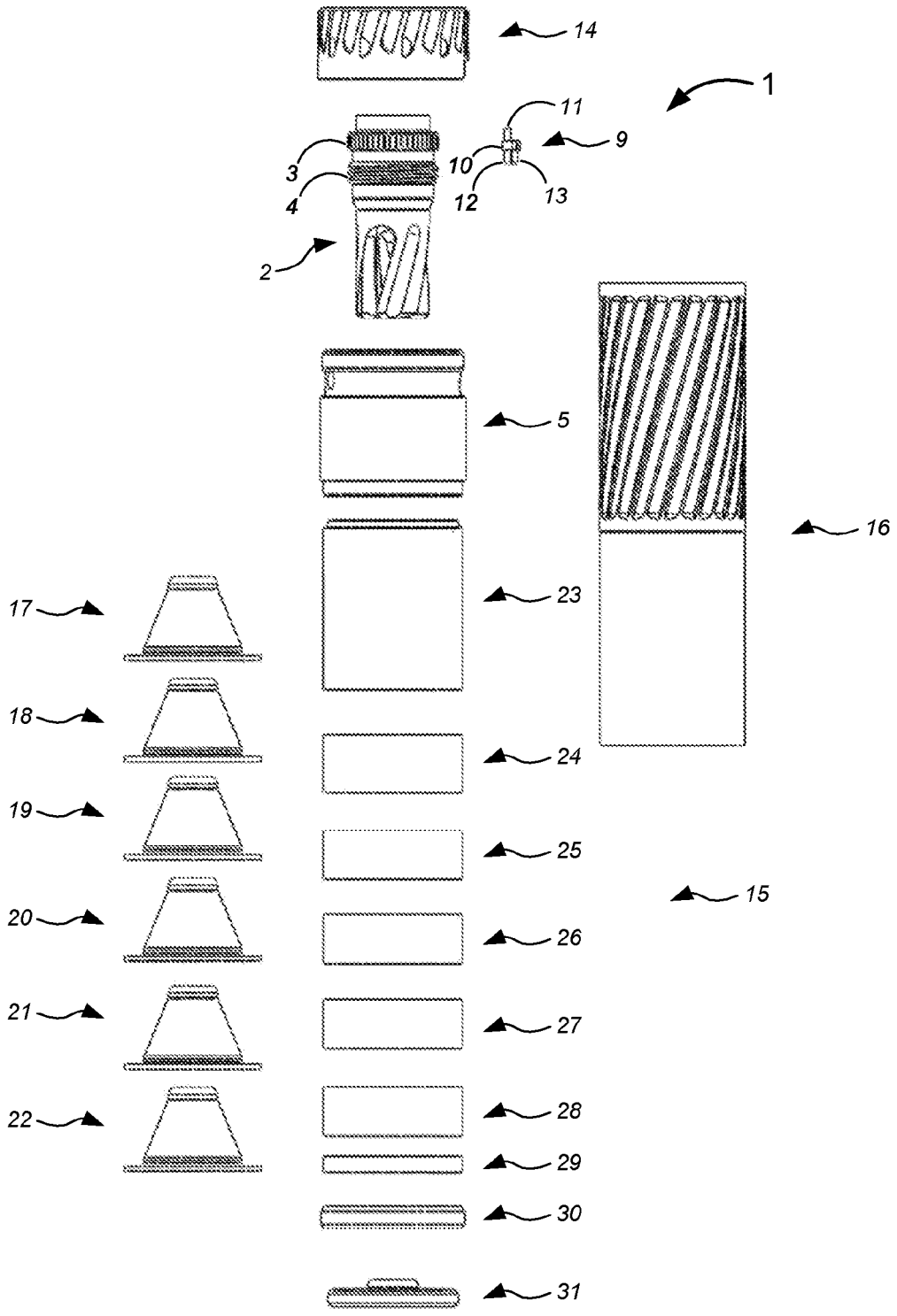
FIG. 3 shows an exploded side view of an embodiment of the present invention along with an exploded side view of an exemplary noise suppressor.

FIG. 3 shows an exploded side view of locking mechanism 1 along with an exploded side view of an exemplary noise suppressor 15. Noise suppressor 15 includes proximal end cap 5, outer tube 16, baffles 17-22, blast chamber 23, spacers 24-30, and distal end cap 31.

Noise suppressor 15 is primarily attached to muzzle attachment 2 by joining threaded interface 4 with threaded interface 6 as shown in FIG. 1. However, during rapid fire use this threaded attachment between threads 4 and thread 6 can come loose, which can cause noise suppressor 15 to become misaligned with muzzle attachment 2. As described further below, locking mechanism 1 prevents this problem by adding a secondary form of attachment.

Figure 4:
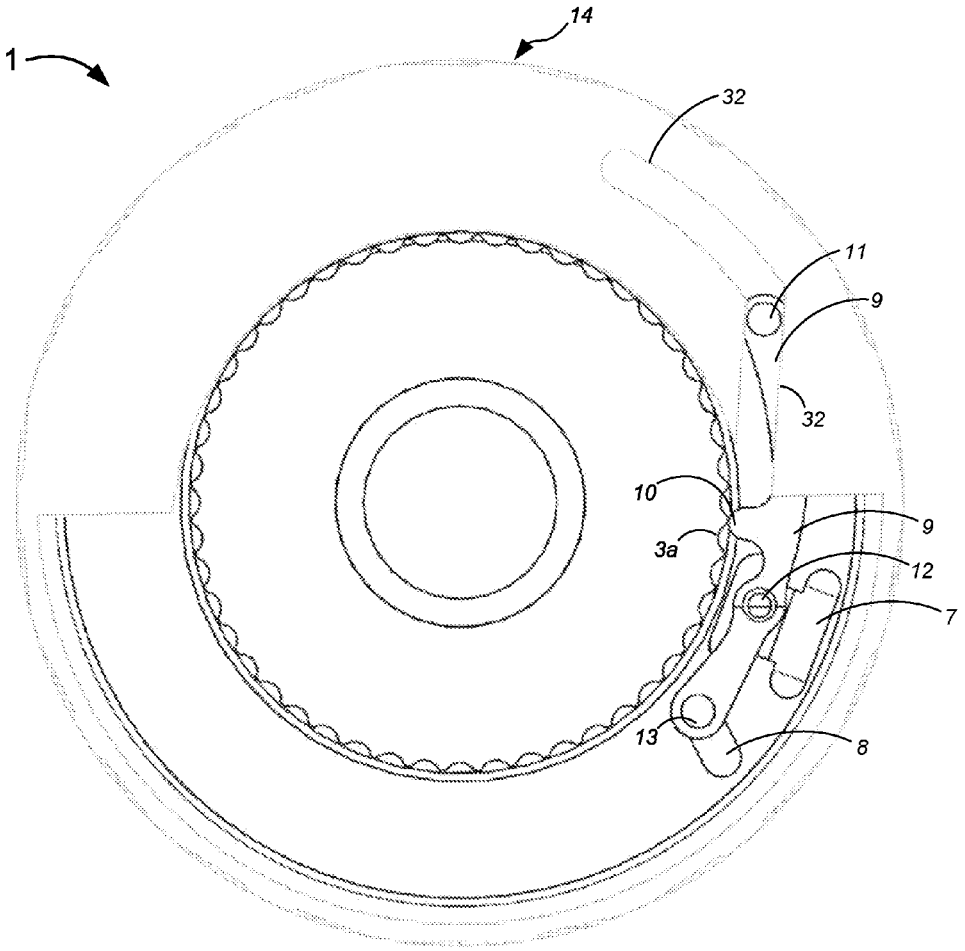
FIG. 4 shows a cross sectional view of the suppressor locking mechanism through the collar slot of an embodiment of the present invention where the locking notch is initially misaligned with the locking positions of the muzzle attachment.

FIG. 4 shows a cross sectional view of locking mechanism 1 where locking mechanism 1 has been initially attached to noise suppressor 15 by rotating collar 14 counterclockwise in order to engage locking notch 10 with locking positions 3. As used in this detailed description, the terms "counterclockwise" and "clockwise" are defined as viewed from the proximal end of collar 14 as shown in FIG. 4. However, as shown in FIG. 4, when locking notch 10 was initially engaged with locking positions 3, locking notch 10 is misaligned with locking position 3*a*. Without a further adjustment, locking notch 10 could move clockwise and loosen the attachment between noise suppressor 15 and muzzle attachment 2 or locking notch 10 could become damaged as collar 14 is further tightened counterclockwise.

To address this problem, FIG. 4 further shows additional components of locking mechanism 1, including first proximal end cap pin 12 positioned within first proximal end cap slot 7 and second proximal end cap pin 13 positioned within second proximal end cap slot 8. Locking mechanism 1 further comprises collar 14, which includes collar slot 32, and locking arm 9. As shown in FIG. 4, collar pin 11 is positioned within collar slot 32. As described further below, as collar 14 is rotated counterclockwise in this exemplary embodiment, collar slot 32 pushes down on collar pin 11, which causes locking arm 9 to push locking notch 10 clockwise into a locking position 3*a*. In this particular embodiment locking positions 3 are defined by a series of teeth as shown in FIG. 4, however, locking positions can be defined by any number of features.

Figure 5:
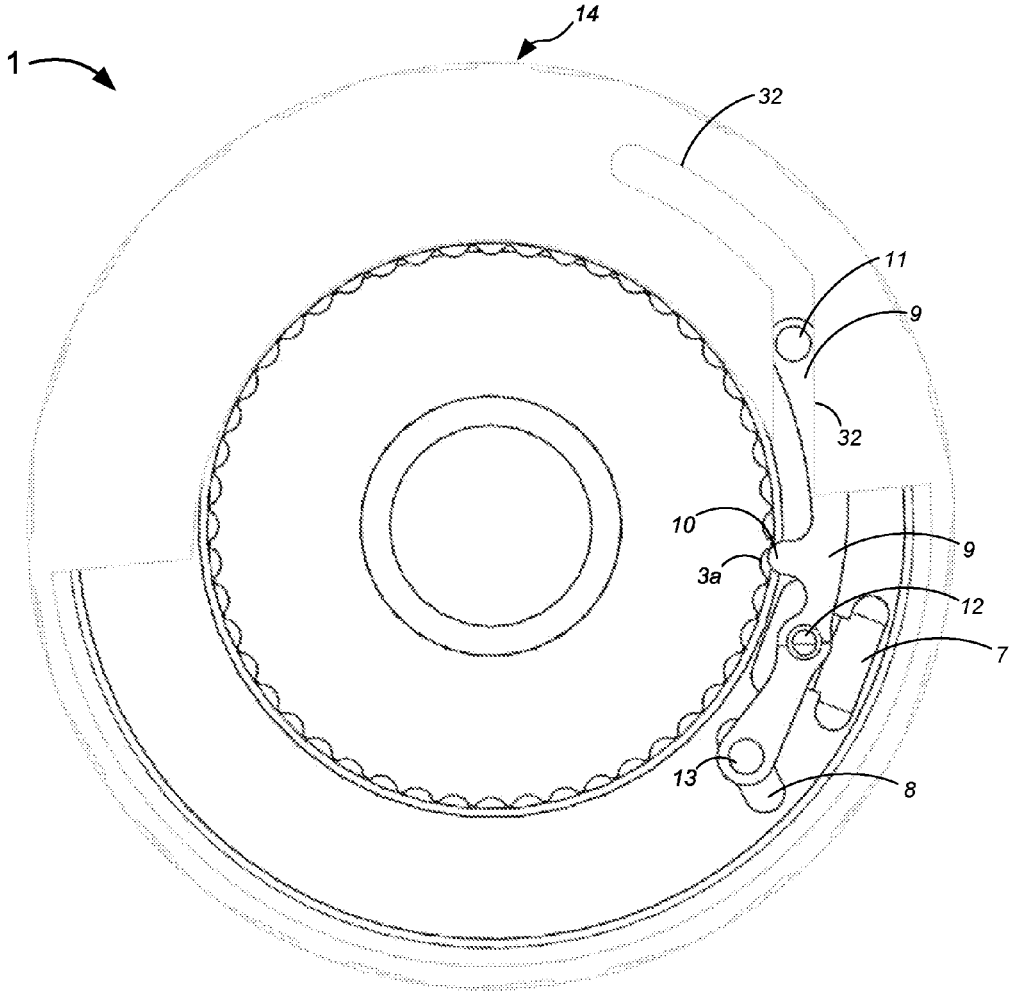
FIG. 5 shows a cross sectional view of the suppressor locking mechanism through the collar slot of an embodiment of the present invention where the locking notch is in the process of being pushed into alignment with the locking positions of the muzzle attachment.

FIG. 5 shows a cross sectional view of locking mechanism 1 where collar 14 has been partially rotated counterclockwise from its position shown in FIG. 4. As shown in FIG. 5, as collar 14 has been rotated counterclockwise, collar slot 32 has pushed down on collar pin 11 and moved collar pin 11 to a position further down collar slot 32. This movement of collar pin 11 has caused locking arm 9 to push locking notch 10 in a circular, clockwise direction closer to locking position 3*a*.

Figure 6:
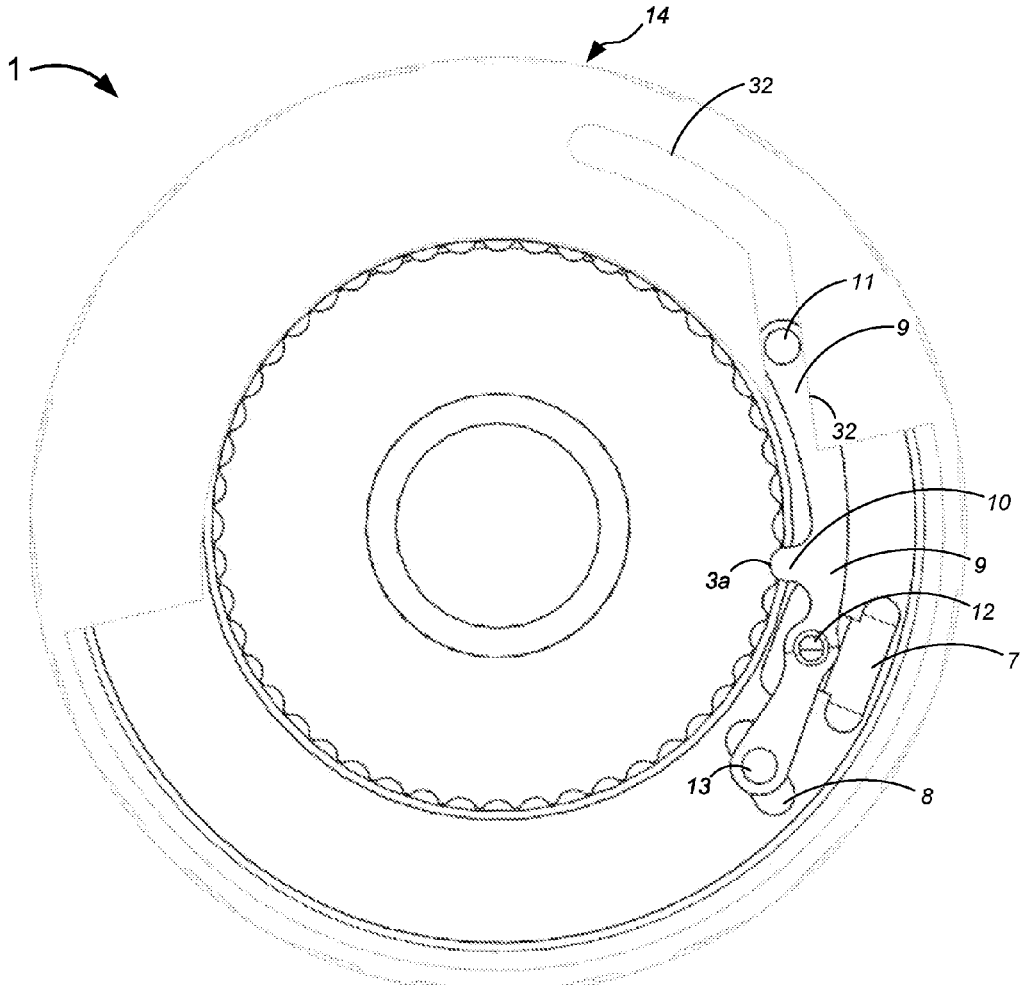
FIG. 6 shows a cross sectional view of the suppressor locking mechanism through the collar slot of an embodiment of the present invention where the locking notch has been pushed into alignment with the locking positions of the muzzle attachment.
Figure 7:
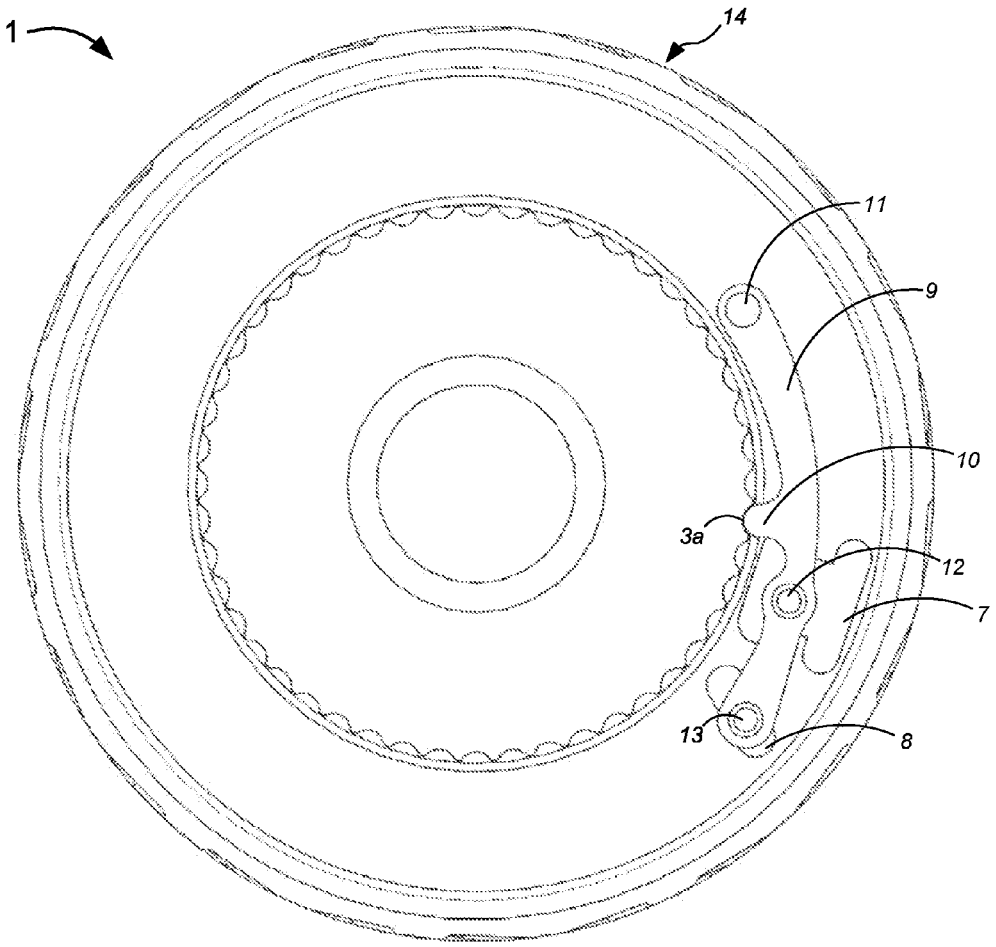
FIG. 7 shows a cross sectional view of the suppressor locking mechanism beyond the collar slot of an embodiment of the present invention where the locking notch has been pushed into alignment with the locking positions of the muzzle attachment.

FIG. 6 shows cross sectional view of locking mechanism 1 where collar 14 has been further rotated counterclockwise from its position shown in FIG. 5. As shown in FIG. 6, collar pin 11 has been further moved down collar slot 32, which has caused locking arm 9 to further push locking notch 10 into a fully locked position within locking position 3*a*. In order to show the entirety of locking arm 9, FIG. 7 shows a cross sectional view of the suppressor locking mechanism beyond the collar slot of an embodiment of the present invention where locking notch 10 is in the same fully locked position within locking position 3*a* as shown in FIG. 6. When in the position shown in FIGS. 6 and 7, noise suppressor 15 is fully locked onto muzzle attachment 2 and cannot become loose during rapid fire use.

Figure 8:
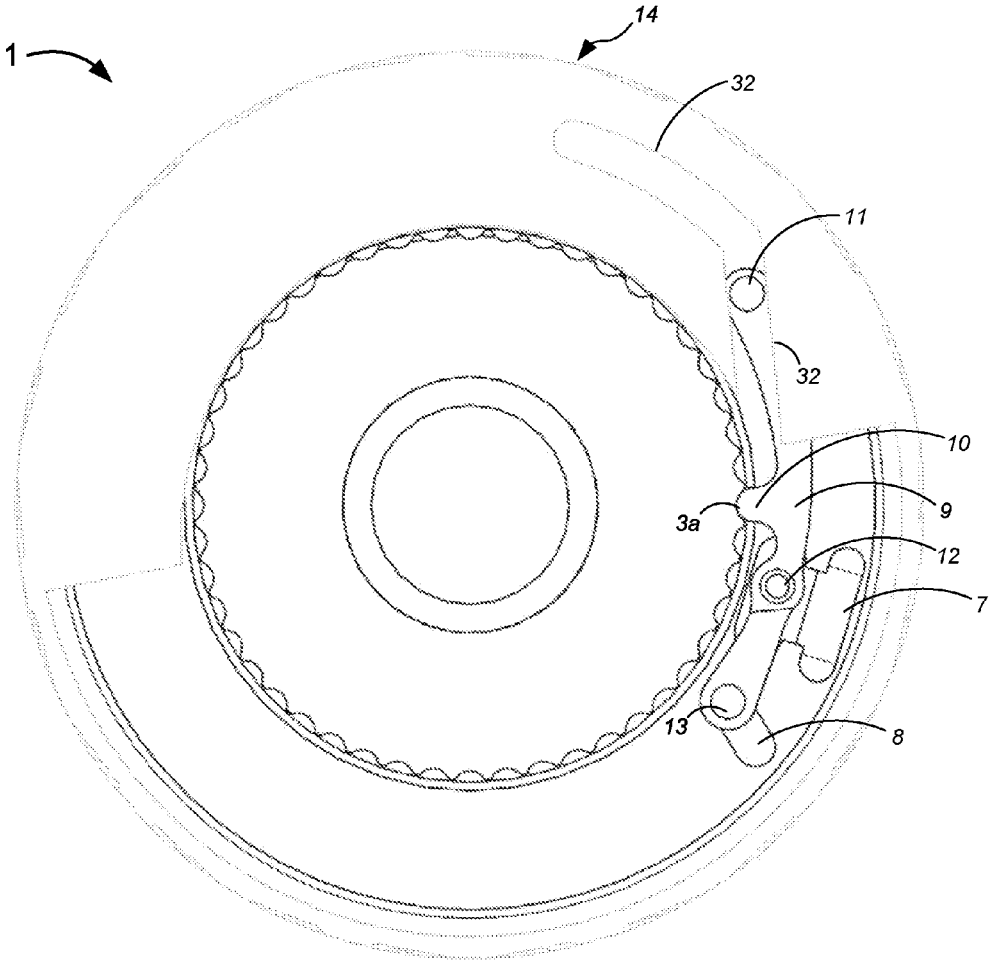
FIG. 8 shows a cross sectional view of the suppressor locking mechanism through the collar slot of an embodiment of the present invention where the locking notch is initially aligned with the locking positions of the muzzle attachment and does not need further adjustment.

Unlike the initially misaligned circumstance shown in FIG. 4, FIG. 8 shows the circumstance where locking mechanism 1 has been initially attached to noise suppressor 15 and locking notch 10 is already aligned with locking position 3*a*. In such circumstances, as shown in FIG. 8, locking arm 9 will prevent collar 14 from being moved farther counterclockwise and noise suppressor 15 will be fully locked onto muzzle attachment 2.

FIGS. 9-12 show another embodiment of the present invention. In this embodiment, collar slot 32, first and second proximal end cap slots 7 and 8, and locking arm 9 are configured slightly differently in order to allow locking arm 9 to pull (as opposed to push) locking notch 10 into a fully locked position within locking position 3*a*.

Figure 9:
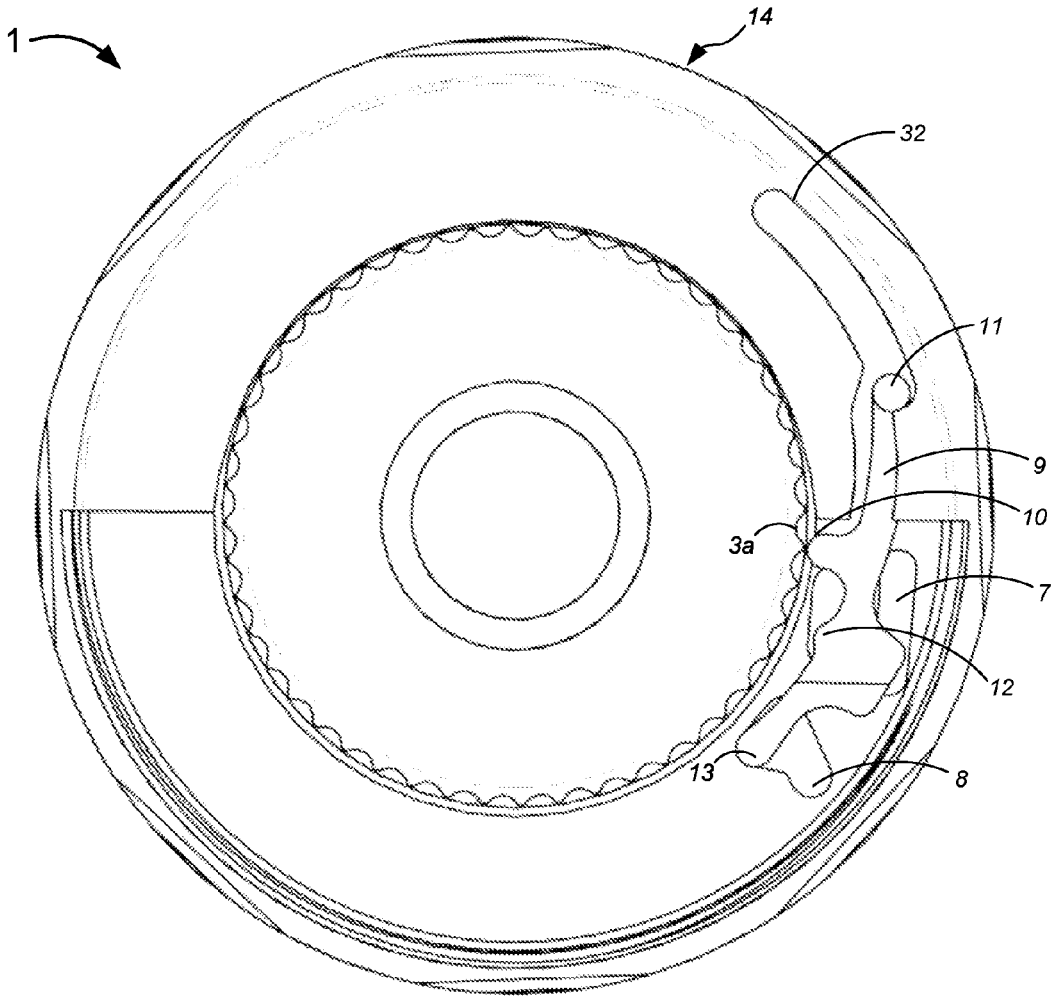
FIG. 9 shows a cross sectional view of the suppressor locking mechanism through the collar slot of another embodiment of the present invention where the locking notch is initially misaligned with the locking positions of the muzzle attachment.

FIG. 9 shows a cross sectional view of locking mechanism 1 where locking mechanism 1 has been initially attached to noise suppressor 15 and locking notch 10 is initially misaligned with locking positions 3. FIG. 9 further shows first proximal end cap pin 12 positioned within first proximal end cap slot 7 and second proximal end cap pin 13 positioned within second proximal end cap slot 8. FIG. 9 further shows collar 14, which includes collar slot 32, and locking arm 9. As shown in FIG. 9, collar pin 11 is positioned within collar slot 32. As described further below, as collar 14 is rotated counterclockwise in this exemplary embodiment, collar slot 32 pulls down on collar pin 11, which causes locking arm 9 to pull locking notch 10 in a circular, counterclockwise direction into locking position 3*a*.

Figure 10:
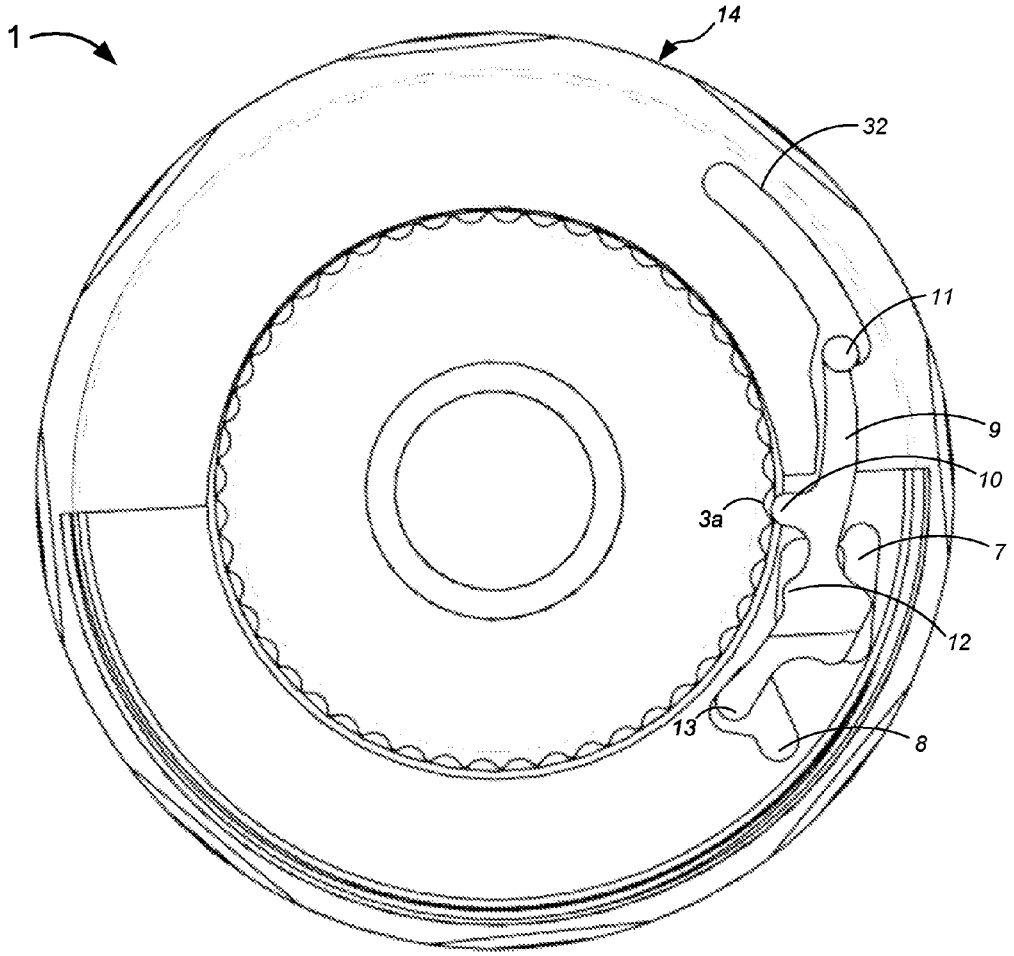
FIG. 10 shows a cross sectional view of the suppressor locking mechanism through the collar slot of another embodiment of the present invention where the locking notch is in the process of being pulled into alignment with the locking positions of the muzzle attachment.

FIG. 10 shows a cross sectional view of locking mechanism 1 where collar 14 has been partially rotated counterclockwise from its position shown in FIG. 9. As shown in FIG. 10, as collar 14 has been rotated counterclockwise, collar slot 32 has pushed down on collar pin 11 and moved collar pin 11 into a position further down collar slot 32. This movement of collar pin 11 has caused locking arm 9 to pull locking notch 10 closer to locking position 3*a*.

Figure 11:
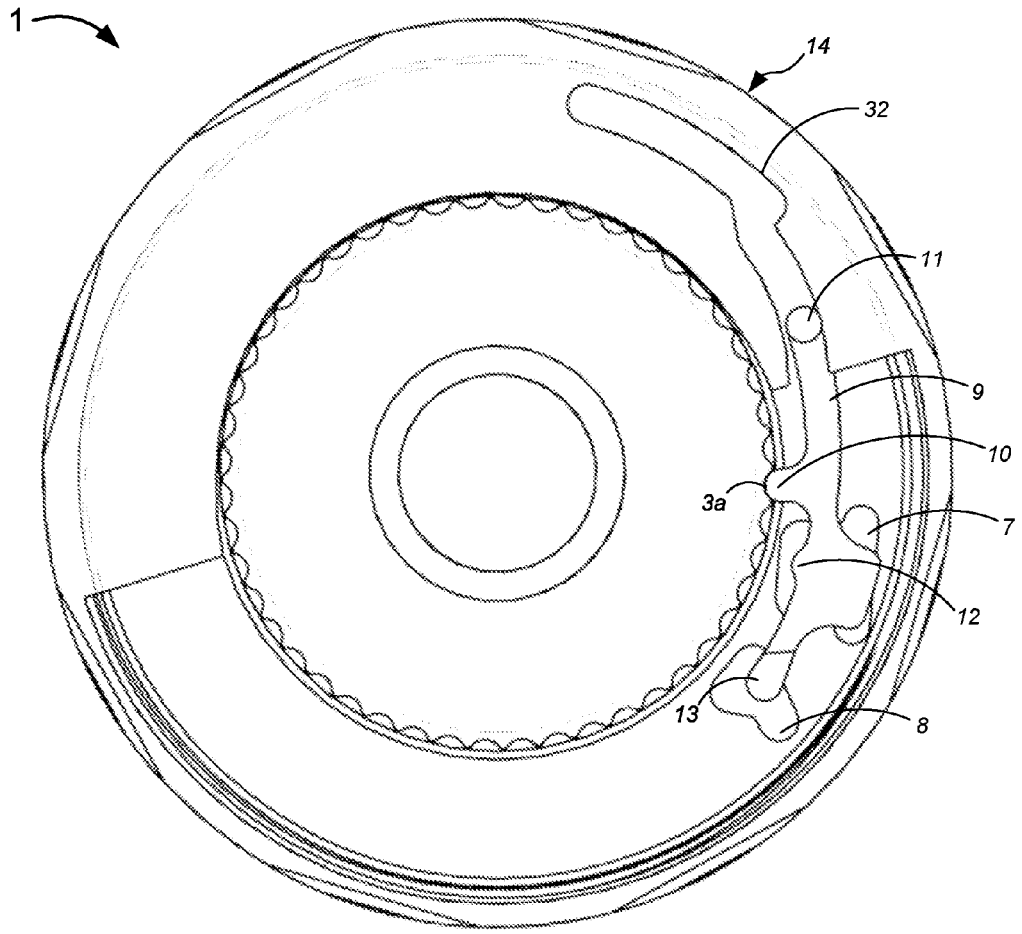
FIG. 11 shows a cross sectional view of the suppressor locking mechanism through the collar slot of another embodiment of the present invention where the locking notch has been pulled into alignment with the locking positions of the muzzle attachment.

FIG. 11 shows cross sectional view of locking mechanism 1 where collar 14 has been further rotated counterclockwise from its position shown in FIG. 10. As shown in FIG. 11, collar pin 11 has been further moved down collar slot 32, which has caused locking arm 9 to further pull locking notch 10 into a fully locked position within locking position 3*a*. When in the position as shown in FIG. 11, noise suppressor 15 is fully locked onto muzzle attachment 2.

Figure 12:
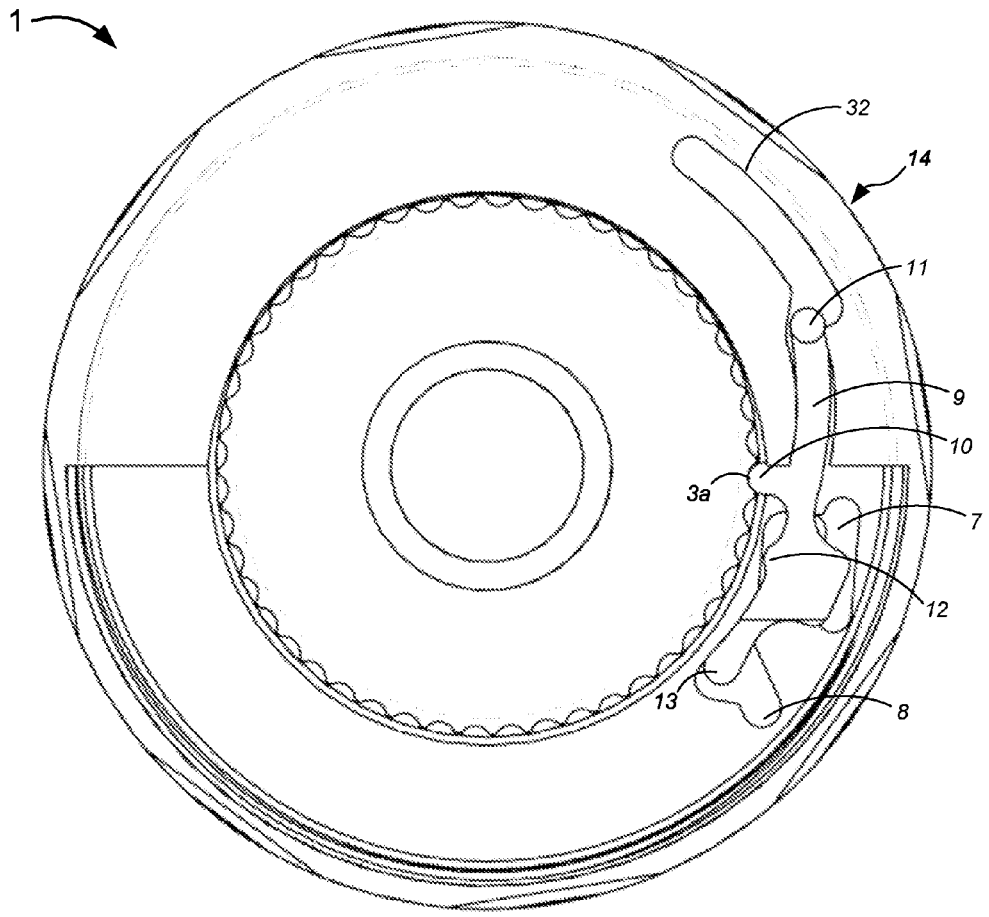
FIG. 12 shows a cross sectional view of the suppressor locking mechanism through the collar slot of another embodiment of the present invention where the locking notch is initially aligned with the locking positions of the muzzle attachment and does not need further adjustment.

Unlike the initially misaligned circumstances shown in FIG. 9, FIG. 12 shows the circumstance where locking mechanism 1 has been initially attached to noise suppressor 15 and locking notch 10 is already aligned with locking position 3*a*. In such circumstances, as shown in FIG. 12, locking arm 9 will prevent collar 14 from being moved farther counterclockwise and noise suppressor 15 will be fully locked onto muzzle attachment 2.

While various embodiments of the apparatus are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A noise suppressor locking mechanism for a firearm comprising:

a muzzle attachment comprising a first threaded interface and a plurality of locking positions;

a collar comprising a locking slot and a proximal end;

a noise suppressor comprising a proximal end cap wherein the proximal end cap comprises a first proximal end cap slot, a second proximal end cap slot, and a second threaded interface;

a locking arm comprising a locking notch, a collar pin, a first proximal end cap pin, and a second proximal end cap pin wherein the collar pin can be positioned within the locking slot, the first proximal end cap pin can be positioned within the first proximal end cap slot, and the second proximal end cap pin can be positioned within the second proximal end cap slot; and wherein the noise suppressor attaches to the muzzle attachment by joining the first threaded interface with the second threaded interface; and wherein the collar rotates the locking arm in order to move the locking notch in a circular direction into a locking position.

2. The suppressor of claim 1, wherein the locking arm pushes the locking notch into a locking position.

3. The suppressor of claim 2, wherein the collar rotates counterclockwise and the locking notch moves in a clockwise direction as viewed from the proximal end of the collar.

4. The suppressor of claim 1, wherein the locking arm pulls the locking notch into a locking position.

5. The suppressor of claim 4, wherein the collar rotates counterclockwise and the locking notch moves in a counterclockwise direction as viewed from the proximal end of the collar.

6. A noise suppressor locking mechanism for a firearm comprising:

a muzzle attachment comprising a plurality of locking positions;

a collar comprising a locking slot;

a noise suppressor comprising a proximal end cap wherein the proximal end cap comprises a first proximal end cap slot and a second proximal end cap slot;

a locking arm comprising a locking notch, a collar pin, a first proximal end cap pin, and a second proximal end cap pin wherein the collar pin can be positioned within the locking slot, the first proximal end cap pin can be positioned within the first proximal end cap slot, and the second proximal end cap pin can be positioned within the second proximal end cap slot, wherein the collar rotates to move the locking notch in a circular direction into a locking position.

7. The suppressor of claim 6, wherein the locking arm pushes the locking notch into a locking position.

8. The suppressor of claim 7, wherein the collar rotates counterclockwise and the locking notch moves in a clockwise direction as viewed from the proximal end of the collar.

9. The suppressor of claim 6, wherein the locking arm pulls the locking notch into a locking position.

10. The suppressor of claim 9, wherein the collar rotates counterclockwise and the locking notch moves in a counterclockwise direction as viewed from the proximal end of the collar.

11. A method of attaching a noise suppressor to a muzzle attachment, the method comprising:

attaching the muzzle attachment to a firearm wherein the muzzle attachment comprises a plurality of locking positions;

attaching a noise suppressor to the muzzle attachment utilizing a locking mechanism comprising a collar comprising a locking slot, a proximal end cap comprising a first proximal end cap slot and a second proximal end cap slot, and a locking arm comprising a locking notch, a collar pin, a first proximal end cap pin, and a second proximal end cap pin, wherein the collar pin can be positioned within the locking slot, the first proximal end cap pin can be positioned within the first proximal end cap slot, and the second proximal end cap pin can be positioned within the second proximal end cap slot; and rotating the collar to move the locking arm and locking notch in a circular direction into a locking position.

12. A method of claim 11, wherein, the locking arm pushes the locking notch into a locking position.

13. A method of claim 12, wherein the collar rotates counterclockwise and the locking notch moves in a clockwise direction as viewed from the proximal end of the collar.

14. A method of claim 11, wherein the locking arm pulls the locking notch into a locking position.

15. A method of claim 14, wherein the collar rotates counterclockwise and the locking notch moves in a counterclockwise direction as viewed from the proximal end of the collar.

* * * * *